US007990033B2

(12) United States Patent
Nakata et al.

(10) Patent No.: US 7,990,033 B2
(45) Date of Patent: Aug. 2, 2011

(54) DISPLAY DEVICE, METHOD OF MANUFACTURING THEREOF, AND METHOD OF IMPROVING VISIBILITY

(75) Inventors: Toshiki Nakata, Ichihara (JP); Toshio Saruyama, Sakura (JP); Toyohiko Fujisawa, Ichihara (JP); Toru Imaizumi, Ichihara (JP); Kouichi Ozaki, Tokyo (JP); Takaki Aoyama, Sodegaura (JP)

(73) Assignee: Dow Corning Toray Company, Ltd., Chiyoda-Ku, Tokyo (JP)

( * ) Notice: Subject to any disclaimer, the term of this patent is extended or adjusted under 35 U.S.C. 154(b) by 277 days.

(21) Appl. No.: 12/304,646

(22) PCT Filed: Jun. 6, 2007

(86) PCT No.: PCT/JP2007/061848
§ 371 (c)(1),
(2), (4) Date: May 11, 2009

(87) PCT Pub. No.: WO2007/145226
PCT Pub. Date: Dec. 21, 2007

(65) Prior Publication Data

US 2010/0148649 A1 Jun. 17, 2010

(30) Foreign Application Priority Data

Jun. 14, 2006 (JP) ..... 2006-164682

(51) Int. Cl.
*H05B 33/10* (2006.01)

(52) U.S. Cl. ..... 313/110; 445/24

(58) Field of Classification Search ..... 257/40, 257/72, 98–100, 642–643, 759; 313/498–512, 313/110–117; 315/169.1, 169.3; 427/58, 427/64, 66, 532–535, 539; 428/690–691, 428/917; 438/26–29, 34, 82, 455; 445/24–25
See application file for complete search history.

(56) References Cited

FOREIGN PATENT DOCUMENTS

| | | | |
|---|---|---|---|
| JP | 05152606 | A | 6/1993 |
| JP | 2000114600 | A | 4/2000 |
| JP | 2000114605 | A | 4/2000 |
| JP | 2000136275 | A | 5/2000 |

OTHER PUBLICATIONS

English language translation and abstract for JP 05152606 extracted from PAJ database, dated May 18, 2009, 37 pages.
English language translation and abstract for JP 2000114600 extracted from PAJ database, dated May 18, 2009, 28 pages.
English language translation and abstract for JP 2000114605 extracted from PAJ database, dated May 19, 2009, 31 pages.
English language translation and abstract for JP 2000136275 extracted from PAJ database, dated May 18, 2009, 39 pages.
PCT International Search Report for PCT/JP2007/061848, dated Oct. 11, 2007, 3 pages.

*Primary Examiner* — Nimeshkumar D Patel
*Assistant Examiner* — Donald L Raleigh
(74) *Attorney, Agent, or Firm* — Howard & Howard Attorneys PLLC

(57) ABSTRACT

A display device having a surface with light-emitting regions and non-light-emitting regions, wherein the aforementioned light-emitting regions and non-light-emitting regions are subjected to simultaneous surface treatment selected from: (1) brush treatment; (2) blast treatment; or (3) combined brush and blast treatment, whereby after the aforementioned treatment the surfaces of the light-emitting regions have a 60°-mirror-surface glossiness according to JIS Z 8741 exceeding 20%, while the surfaces of the non-light-emitting regions have a 60°-mirror-surface glossiness according to JIS Z 8741 not exceeding 20%, has good visibility of images reproduced by the display, which is especially suitable for outdoor application.

20 Claims, 1 Drawing Sheet

DISPLAY DEVICE, METHOD OF MANUFACTURING THEREOF, AND METHOD OF IMPROVING VISIBILITY

RELATED APPLICATIONS

This application claims priority to and all the advantages of International Patent Application No. PCT/JP2007/061848, filed on Jun. 6, 2007, which claims priority to Japanese Patent Application No. JP2006-164682, filed on Jun. 14, 2006.

TECHNICAL FIELD

The present invention relates to a display device, a method of manufacturing thereof, and a method of improving the visibility of displayed information.

BACKGROUND ART

It is always desirable for display devices to reproduce easily identifiable (visible) information. It is especially important to provide high visibility of information displayed in public places (e.g., on traffic control signs).

Known methods of improving visibility, e.g., of traffic control signs, consists of increasing contrast of images by using two different colors, e.g., painting a sign with a red coating on a white background, or painting a sign with a white coating on a green background. Methods of improving visibility introduced into practice in the recent years are based on increasing contrast by using not only a difference in colors but also reflecting properties, e.g., by using colored resins that reflect headlight of an automobile.

Furthermore, in the recent years light-emitting diodes (LEDs) find rapidly growing indoor and outdoor application in publicly used display devices, and display devices that incorporate light-emitting diodes provide excellent visibility without the use of color-reflecting coatings since images can be reproduced by the light-emitting diodes themselves.

Typically, a display that uses light-emitting diodes comprises an electronic circuit board with a plurality of light-emitting diodes arranged in a matrix form, wherein images are reproduced by combining light-emitting and non-light-emitting regions, if necessary, with an addition of combinations of various colors. It is also a common practice to protect the regions illuminated by means of light-emitting diodes by coating these regions with an organic resin such as a transparent epoxy resin.

The LEDs themselves, as well as of the electronic circuit boards that support the light-emitting diodes, except for those regions that are protected by organic resin coatings, need to be protected from external environmental affects, such as water, dust, etc. Various methods of protection can be used for this purpose, but a most widely used method is coating of the LED-supporting circuit board, except for the aforementioned light-emitting regions, with a soft material, i.e., with a potting material. Since on the circuit board the potting material itself does not emit light, it constitutes a background area (non-light-emitting regions) between the light-emitting diodes.

In order to be adhesive to light-emitting diodes and the electronic circuit board, and at the same time to absorb physical deformations caused by heat and impacts, the potting material should be an elastomer. Since in a display that contains light-emitting diodes the latter should be distributed with high density, it is desirable to use such a potting material that, prior to curing, can easily penetrate into narrow spaces between the light-emitting diodes and that possesses low viscosity. In particular, if the display device is intended for outdoor application and if water penetrates into the aforementioned cracks or areas of disconnection, a potting material that has low weather-proof properties will be subject either to cracking, or to decrease in adhesive bond with light-emitting diodes and disconnection from them, or to deterioration of the circuit board. For the above reasons, an elastomer-type potting material, especially a silicone elastomer-type potting material that is capable of overcoming the above problems is the most widely used.

However, a problem associated with display devices that have background areas between the light-emitting diodes made from a potting material is that glossiness of the aforementioned background impairs visibility of the displayed image. Visibility of the displayed images is particularly impaired by light reflected from the background surfaces when a display device is used outdoors and is irradiated with solar rays. An elastomer-type potting material, in particular one that has low viscosity prior to curing, is subject to increase in glossiness after curing, but since this tendency is especially strong in silicone elastomer-type potting materials, a strong demand exists in finding a way of improving visibility by eliminating or diminishing light reflected from the backgrounds of the aforementioned type.

Heretofore, several methods were proposed for eliminating or diminishing reflection from background areas of displays.

For example, Japanese Unexamined Patent Application Publication (hereinafter referred to as "Kokai") 2000-136275 discloses a method in which a potting material that contains a polyisobutylene-type polymer, a curing agent with hydrosilyl groups (Si—H groups), and an organic compound with alkenyl or alkynyl groups is combined with silica or a similar gloss-reducing agent. However, as can be seen from Application Example 2 of the above publication, the addition of a gloss-reducing agent could produce the value of glossiness not exceeding 45%, which is far from the gloss properties needed for the aforementioned displays.

Furthermore, Kokai 2000-136275 also discloses a method according to which glossiness on the surface obtained after curing is reduced by physically modifying the surface, e.g., by treating it with sand paper. However, if this method is used for treating surfaces of displays with a high density of distribution of light-emitting diodes, sand paper can either damage the aforementioned light-emitting diodes, or, if the elements projects from the surface of the potting material, the areas around the projecting elements become inaccessible for treatment with sand paper. Therefore, the above method did not find practical application.

Kokai H05-152606 discloses a construction which consists of a first resin layer, the main purpose of which is to secure light-emitting diodes on the electric circuit board, and a second resin layer, applied onto the first layer, the main purpose of which is to eliminate reflection. Such a construction, however, involves two resin layers on the electronic circuit board, cannot eliminate reflection in one treatment step, and requires complicated multiple-step operations.

It was further proposed in Kokai H05-152606, to impart to the surface of the first layer a reflection elimination function, instead of the formation of the second layer on the first layer. For example, as shown in FIG. 5 of the aforementioned patent publication, it is recommended to apply onto the first layer a tape-like cloth and to press this cloth to the first layer for imprinting the cloth texture on the surface of the resin layer in order to form on this surface fine unevenness, while the first layer is still in a soft state prior to complete curing.

However, the above method can be realized only at an experimental level, and is not suitable for industrial conditions. The first reason is that it is rather difficult to fix the time for transfer of the cloth texture to the resin coating during curing of the first layer. If the selected time is too short, the cloth will adhere to the first layer and it will be difficult to peel it off from the layer, and if the time is too long, it will be impossible to transfer the texture image to the layer. The second reason is that it is difficult to press the cloth to the areas in the vicinity of light-emitting diodes that project from the first layer, whereby it is impossible to provide uniform distribution of pressure over the entire surface of the first layer. As a result, the background will inevitably acquire non-uniform glossiness.

Furthermore, as shown in FIG. 6 of Kokai H05-152606, it was also suggested to apply finely powdered black resin onto the first layer, and then to remove the fine particles distributed over the surface. However, this method requires spreading of particles when the first layer is still in a soft state. Another problem is that the fine black powder is widely spread into the environment.

As shown in FIG. 7 of aforementioned Kokai H05-152606, it was further suggested to form the second layer from a mixture of fine particles of glass and silica. However, similar to Application Example 2 of Kokai 2000-136275, this method does not eliminate reflection and does not decrease glossiness to a practically acceptable level.

Thus, several proposals were offered heretofore for eliminating reflection from the background or for reducing background glossiness, but none of these proposals could reach the level suitable for practical use.

Keeping in mind the problems of the prior-art technique, it is an object of the present invention to provide a display device having light-emitting regions and non-light-emitting regions, wherein practically acceptable elimination of reflection or minimization of glossiness of non-light-emitting regions can be achieved in one reliable and easily executable treatment operation that results in obtaining good visibility of images reproduced by the display device, which is especially suitable for outdoor application.

DISCLOSURE OF INVENTION

The above object is achieved by means of the present invention that provides a display device having a surface with light-emitting regions and non-light-emitting regions, wherein the aforementioned light-emitting regions and non-light-emitting regions are subjected to simultaneous surface treatment selected from:

(1) brush treatment;

(2) blast treatment; or (3) combined brush and blast treatment, whereby after the aforementioned treatment the surfaces of the light-emitting regions have a 60°-mirror-surface glossiness according to JIS Z 8741 exceeding 20%, while the surfaces of the non-light-emitting regions have a 60°-mirror-surface glossiness according to JIS Z 8741 not exceeding 20%.

The invention also provides a method of manufacturing a display device having a surface with light-emitting regions and non-light-emitting regions, comprising the step of subjecting the aforementioned light-emitting regions and non-light-emitting regions to simultaneous surface treatment selected from:

(1) brush treatment;

(2) blast treatment; or (3) combined brush and blast treatment, whereby after the aforementioned treatment the surfaces of the light-emitting regions have a 60°-mirror-surface glossiness according to JIS Z 8741 exceeding 20%, while the surfaces of the non-light-emitting regions have a 60°-mirror-surface glossiness according to JIS Z 8741 not exceeding 20%.

In the aforementioned display device and method, at least a part of the light-emitting regions may project from the aforementioned surface, and the Young's modulus of the aforementioned light-emitting regions at 25° C. may be equal to or greater than 100 MPa, while the Young's modulus of the aforementioned non-light-emitting regions at 25° C. may be equal to or lower than 10 MPa.

It is recommended that a brush used for the aforementioned brush treatment be made from plastic.

It is recommended that a material used for the aforementioned blast treatment be a dry ice powder, sodium carbonate powder, sodium hydrogencarbonate powder, plastic powder, or a vegetation powder.

It is recommended that the light-emitting regions be composed of light-emitting semiconductor elements, the non-light-emitting regions be made from an elasticity organic material, in particular, a silicone elastomer.

The above method may further comprise the step of curing the aforementioned elasticity organic material and performing the aforementioned surface treatment after the hardness of the elasticity organic material exceeds 50% of the final hardness. The method may also include a step of antistatic treatment of the aforementioned surface.

It is another object of the invention to improve the visibility of a display device having a surface with light-emitting regions and non-light-emitting regions, wherein the aforementioned light-emitting regions and non-light-emitting regions are subjected to simultaneous surface treatment selected from:

(1) brush treatment;

(2) blast treatment; or (3) combined brush and blast treatment, whereby after the aforementioned treatment the surfaces of the light-emitting regions have a 60°-mirror-surface glossiness according to JIS Z 8741 exceeding 20%, while the surfaces of the non-light-emitting regions have a 60°-mirror-surface glossiness according to JIS Z 8741 not exceeding 20%.

In the context of the present application, the term "simultaneous" means that the light-emitting regions and non-light-emitting regions are treated in one continuous operation, irrespective of whether in this continuous operation the light-emitting regions and non-light-emitting regions are treated in one sequence or in an opposite sequence. For example, in the case of brush treatment, the term "simultaneous" treatment is not limited only by simultaneous contact of the brush with light-emitting and non-light-emitting regions, but first the brush can perform treatment in contact with the light-emitting regions (or non-light-emitting regions), then the brush may move in contact or non-contact with the display surface, and then the brush may perform surface treatment of non-light-emitting (or light-emitting) regions. Furthermore, in the case of blast treatment, the process of "simultaneous" blasting is not limited merely to simultaneous blasting of both light-emitting and non-light-emitting regions, and first the light-emitting (or non-light-emitting regions) may be subjected to blast treatment, then the nozzle or another blast-treatment tool may be moved along the surface of the display device, and then the non-light-emitting regions (or light-emitting regions) may be surface treated. Furthermore, processing time of the light-emitting regions and the non-light-emitting regions may be different.

Effects of Invention

According to the device and method of the invention, a display device composed of light-emitting regions and the non-light-emitting regions may be easily and reliably treated in a single operation to a practically acceptable level so that reflection is eliminated or glossiness is diminished on the non-light-emitting regions without damaging and matting the surfaces of the light-emitting regions. In other words, the invention makes it possible to diminish glossiness selectively only on the non-light-emitting regions of the display composed of light-emitting regions and non-light-emitting regions. Such treatment provides continuous and excellent visibility of information presented by the display with high contrast between the light-emitting regions and the non-light-emitting regions, which is especially efficient for displays used outdoors.

Furthermore, according to the method of the invention for improving visibility, it is possible to improve the visibility on an existing display composed of light-emitting regions and the non-light-emitting regions. This can be achieved easily and reliably in a single operation to a practically acceptable level by eliminating reflection or diminishing glossiness of the non-light-emitting regions without damaging and matting the surfaces of the light-emitting regions. In other words, the method of improving visibility makes it possible to diminish glossiness selectively only on the non-light-emitting regions of the display composed of light-emitting regions and the non-light-emitting regions. Such a method makes it possible to improve visibility of information presented by the existing display devices of poor visibility and to impart to such display devices higher contrast between the light-emitting regions and the non-light-emitting regions.

Especially good visibility is obtained when at least a part of the light-emitting regions projects from the surface of the display since in this case the light-emitting regions become more distinguishable.

REFERENCE NUMBERS

1: frame
2: substrate
3: LED
4: potting material

DETAILED DESCRIPTION OF THE INVENTION

Figure 1:
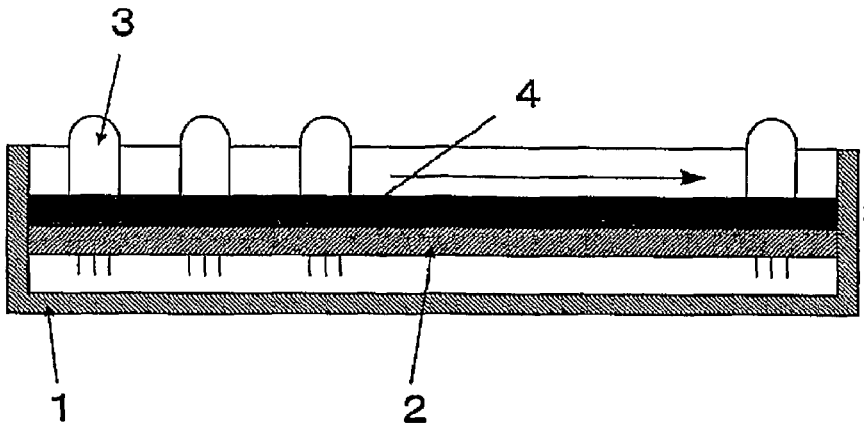
FIG. 1 is a sectional view of a display device made in accordance with one embodiment of the invention.
Figure 2:
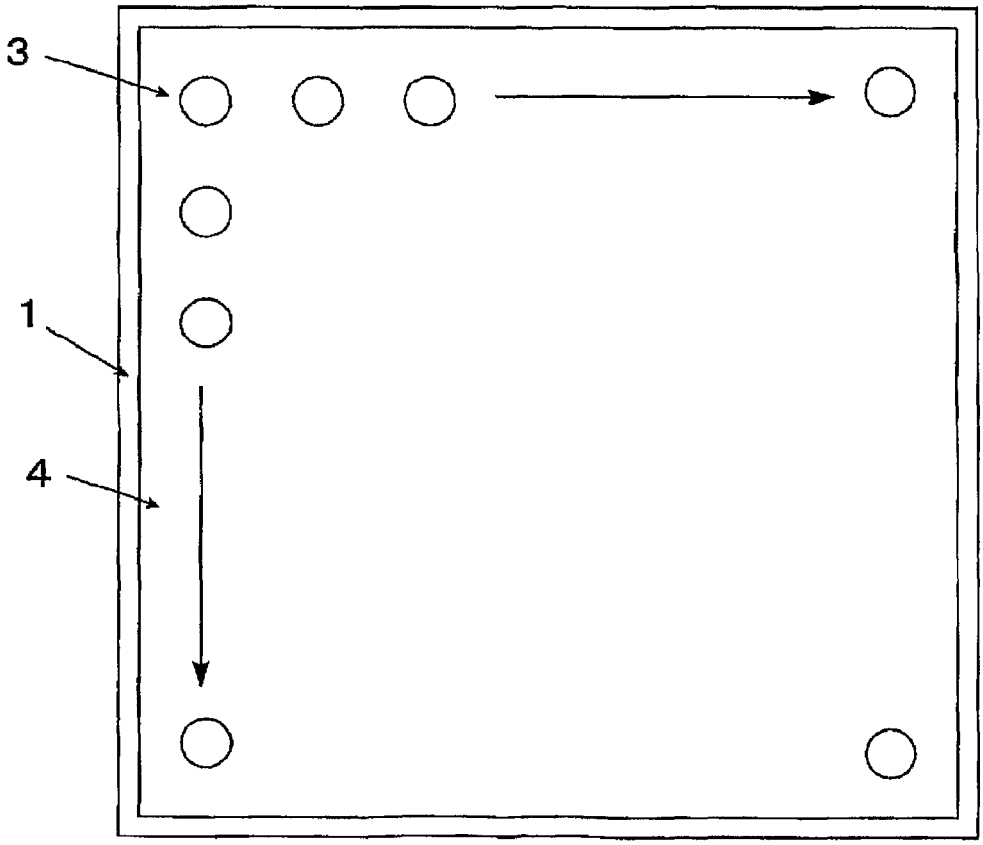
FIG. 2 is a top view of the display device of FIG. 1.

The display device of the invention will now be described in more detail with reference to the drawings, wherein FIG. 1 is a cross-sectional view illustrating one example of a display of the invention, and FIG. 2 is a top view of the display.

The display shown in FIGS. 1 and 2 comprises a substrate 2, which is installed in a frame 1 and supports a plurality of LEDs 3 arranged in the light-emitting regions and protected by a material of high hardness. There are no special restrictions with regard to the aforementioned material of high hardness provided that this material is permeable to light emitted by the LEDs 3, but it may be recommended to use for this purpose a thermoplastic or thermosetting plastic material, preferably a transparent acrylic resin or a transparent epoxy resin. For reinforcement purposes, the periphery of the hard protective material can be surrounded by metal. Although it is not shown in FIGS. 1 and 2, but when the display is used outdoors, in order to protect the display from decrease of visibility because of reflection of solar rays from the light-emitting and non-light-emitting regions, the display may be provided with a light screen alone or with ribs for attachment to the aforementioned frame.

For protection of the substrate 2 and non-light-emitting parts of the LEDs 3, the gaps between the LEDs 3 and between the frame 1 and the LEDs 3 are filled with a potting material 4 which forms the non-light-emitting regions (background) of the display device. The aforementioned potting material 4 protects the substrate 2 and non-light-emitting portions of the LEDs 3 from external factors, such as penetration of external moisture, dust, etc.

In the display device shown in FIGS. 1 and 2, the light-emitting regions of the LEDs 3 project from the surface of the potting material 4, but in order to improve visibility and protect the LEDs 3 from complete embedding in the potting material 4, it is recommended that the light-emitting regions project from the surface of the potting material by at least 0.5 mm, preferably at least 1 mm, more preferably at least 2 mm, further preferably 3 mm, most preferably at least 4 mm, and even better at least 5 mm. However, if the image formed by the light-emitting regions is seen as a background, the light-emitting regions of the LEDs 3 may be arranged at the same level as the surface of the potting material 4. Furthermore, as shown in FIG. 2, the LEDs 3 may be arranged on the substrate 2 in a regular, as well as in irregular manner.

In the display device of FIGS. 1 and 2, the potting material 4 that fills the gaps between the LEDs 3 and between the LEDs 3 and the frame 1 is exposed directly to the outside, and the surface of this material has a 60°-mirror-surface glossiness Gs (60°) according to JIS Z 8741 not exceeding 20%, while the surfaces of the light-emitting regions have a 60°-mirror-surface glossiness Gs (60°) according to JIS Z 8741 exceeding 20%. Therefore, even though the surface of the display receives an external incident light, the display provides high contrast between the light emitted by the LEDs 3 and the light reflected from the potting material 4, and thus provides excellent visibility of images formed by the illuminated LEDs 3.

The 60°-mirror-surface glossiness Gs (60°) according to JIS Z 8741 is a percentage indication of the reflectivity from the surface of the specimen measured at 60° angle of incidence relative to the reflectivity of a smooth surface of a glass having an index of refraction of 1.567, measured at the same standard angle of incidence, as is instructed by JIS Z 8741; for example, 0% means complete elimination of glossiness. When the LEDs 3 are packed on the substrate 2 too densely, it may happen that the areas for reliably measuring glossiness will be inaccessible. In this case, it is necessary to manufacture several comparative specimens with different levels of decrease of glossiness but using the same potting material 4. The glossiness on the surfaces of these specimens is measured. Surface conditions of the comparative specimens obtained by the aforementioned method are visually compared with the surface conditions of the potting material 4 on the object to be measurement, and then, assuming that glossiness on the measured object will correspond to the glossiness of the comparative specimen having the same surface conditions, the glossiness of the non-light-emitting regions of the potting material 4 is assumed as one to several percents lower than on the selected comparative specimen.

It is recommended that in the display device of the invention, the 60°-mirror-surface glossiness Gs (60°) according to JIS Z 8741 on the non-light-emitting regions be not more than 15%, preferably not more than 10%, even more preferably not more than 5%, and most preferably not more than 1%. If the aforementioned glossiness is higher than 20%, then because of insufficient decrease of glossiness it will be impossible to impart to a reproduced image a desired contrast. On the other hand, it is recommended that in the display device of the invention, the 60°-mirror-surface glossiness Gs (60°) according to JIS Z 8741 on the light-emitting regions be more than 30%, preferably more than 40%, even more preferably more than 50%, further more than 60%, even more than 70%, and especially more than 80%.

In the display device shown in FIGS. 1 and 2, the light-emitting regions were formed by semiconductor elements such as LEDs 3. However, the invention is not limited by this example, and light-emitting devices of any other type can be used for the purposes of the invention. Furthermore, in order to create conditions difficult for cracking under the effect of thermal expansion or shrinking, it is recommended to make the potting material 4 that constitutes non-light-emitting regions in a gel-like or elastomer-like form, of which the elastomer form is preferable. More specifically, it is recommended that the Young's modulus of the aforementioned light-emitting regions at 25° C. be equal to or greater than 100 MPa, and the Young's modulus of the aforementioned non-light-emitting regions at 25° C. be equal to or lower than 10 MPa. In order to reduce diffused reflection of external incident light and to improve visibility of images reproduced on the display device, it is recommended to use a potting material 4 of a dark color, preferably of black color.

There are no special limitations with regard to the potting material of the invention, provided that it is in the form of an elastomer, but the most suitable for the purposes of the invention are silicone-type, polyether-type, polyisobutylene-type, polybutadiene-type, polyurethane-type, or a similar elasticity organic material. Among these, most suitable is the silicone elastomer since, prior to curing, this material can be prepared with low viscosity and it easily penetrated into narrow gaps between the LEDs 3. In addition, this material possesses excellent resistance to heat and chemicals, and has high weather-proof properties.

The aforementioned silicone elastomer can be prepared from a curable silicone composition. There are no special restrictions with regard to the mechanism of curing of the aforementioned curable silicone composition. For example, curing can be carried out by hydrosilylation, condensation, UV radiation, with the use of organic peroxide, or by combining the aforementioned curing mechanisms. Preferable among these are curing by hydrosilylation, condensation, or a combination of hydrosilylation and condensation.

A hydrosilylation-curable silicone composition can be exemplified by one comprising a polyorganosiloxane that contains in one molecule at least two silicon-bonded alkenyl groups, a polyorganosiloxane having in one molecule at least two silicon-bonded hydrogen atoms, and a hydrosilylation catalyst.

A condensation-curable silicone composition may be of a de-alcohol type, de-oxime type, de-acetate type, de-amine type, de-ketone type, or a de-amine type. A specific example of such a composition is one comprising at least the following components: a polyorganosiloxane having in one molecule at least two silicon-bonded hydroxyl groups or alkoxy, alkenoxy, acetoxy, or similar silicon-bonded hydrolyzable groups; a silane compound having in one molecule at least two alkoxy groups, alkenoxy groups, acetoxy groups, or a similar silicon-bonded hydrolyzable group, or a product of partial hydrolysis and condensation of the aforementioned silane compound; and a condensation catalyst.

Furthermore, a silicone composition curable by hydrosilylation and condensation is exemplified by one comprising at least the following components: a polyorganosiloxane having in one molecule at least two silicon-bonded alkenyl groups and at least two alkoxy, alkenoxy, acetoxy, or a similar silicon-bonded hydrolyzable group; a polyorganosiloxane having in one molecule at least two silicon-bonded hydrogen; atoms a hydrosilylation catalyst; and a condensation catalyst. The aforementioned composition may also be exemplified by one comprising at least the following components: a polyorganosiloxane having in one molecule at least two silicon-bonded alkenyl groups, a polyorganosiloxane having in one molecule at least two alkoxy groups, alkenoxy groups, acetoxy groups, or a similar silicon-bonded hydrolyzable group; a polyorganosiloxane having in one molecule at least two silicon-bonded hydrogen atoms; a hydrosilylation catalyst; and a condensation catalyst.

The aforementioned hydrosilylation-curable silicone composition is cured at room temperature or by heating, and the condensation-curable silicone composition is cured at room temperature.

The curable silicone composition can be in a liquid or paste-like form. When cured, the composition can strongly adhere as a potting material to the substrate 2 and to the non-light-emitting portions of the LEDs 3. In addition, the curable composition can assist in positioning of the LEDs 3. This allows elimination of spaces between the LEDs 3 and the aforementioned package and prevents penetration of atmospheric moisture, dust, etc., to the substrate.

In addition to forming microroughness in order to minimize glossiness on the surface of the cured silicone, the curable silicone composition may have a dark color, preferably black. For this purpose, the composition may be mixed with a pigment, such as carbon black.

The manufacturing process of the display device of the invention shown in FIGS. 1 and 2 comprises the following steps: arranging a frame (not shown in the drawings) that supports the substrate 2 with a plurality of LEDs 3 into a package, coating the substrate 2 and the non-light-emitting regions of the LEDs 3 with the curable silicone composition, and then curing the aforementioned composition to form an elastomer-type potting material 4; and, at the same time, subjecting the surfaces of the light-emitting regions of the LEDs 3 and the non-light-emitting regions of the potting material 4 on the display device to a surface treatment selected from the following processes:

(1) brushing
(2) blasting
(3) combination of brushing and blasting

Use of the aforementioned surface-treatment processes (1), (2), and (3) makes it possible to diminish surface glossiness without damaging the light-emitting regions of the LEDs 3, to physically form microroughness on the surface of only the potting material 4, to reduce reflection of the diffused light incident onto the aforementioned surface directly to the viewer, and thus to achieve a 60°-mirror-surface glossiness according to JIS Z 8741 exceeding 20% on the surfaces of the light-emitting regions and a 60°-mirror-surface glossiness according to JIS Z 8741 not exceeding 20% surfaces of the non-light-emitting regions.

The aforementioned brush treatment can be carried out by bringing the surface of the substrate device into contact with a rotating or reciprocating brush made from a soft material. For this purpose, the brush is attached to a device that performs rotating or reciprocating motions.

If hardness of the brush material is too low (bristles are too weak), the efficiency of abrasion will be too low as well, and if, on the other hand, the bristles are too rigid, this may damage the light-emitting regions of the LEDs 3, form cracks on the potting material, or separate the potting material 4 from the substrate 2 or from the areas of bonding to the LEDs 3.

The brush can be made from various natural materials of animal or plant origin (such as cotton and bamboo) or from plastics such as organic synthetic plastics. Use of organic synthetic materials, especially plastics, is preferable. Examples of such plastics are the following: polycarbonate; PET or similar polyesters; Nylon or a similar polyimide; polyimide; polypropylene, polyethylene, or a similar polyolefin; polyvinylchloride or a similar polyhalogenated vinyl; or an acrylic resin. The use of Nylon is preferable. For optimization of selection of the material, it is necessary to take into account factors such as LED size, height of projections, density of LED distribution, etc. In general, however, it is recommended to select a brush with bristles having a diameter in the range of 0.1 to 1 mm, preferably 0.3 to 0.7 mm, and with a length of 1 to 100 mm, preferably 5 to 50 mm.

Blasting is impinging the surface with particles of powder. In order not to damage the light-emitting regions of the LEDs 3, the aforementioned powder should have low hardness. Blast powder can be blown onto the surface of the display device by using compressed air or by using a motor-driven air blaster, shot blaster, or deflasher.

If the hardness of the powder particles is too low, this will decrease efficiency of the abrasive treatment. If, on the other hand, hardness of the powder particles is too high, this will damage the light-emitting regions of the LEDs 3, will cause cracking of the potting material 4, and will lead to other defects such as disconnection of the potting material from the substrate 2 and from the areas of bonding to the LEDs 3. Normally, the materials used for blasting without damaging the light-emitting regions of the LEDs 3 are conventional sand, alumina, or a similar metal oxide powder; or a hard metal powder (which is normally used for polishing).

The powder material having the appropriate hardness may comprise pulverized natural substances of animal or plant origin such as apricot pits, walnuts, peach, corncob; plastics such as organic substances, e.g., polycarbonate, PET, or similar polyesters; Nylon or a similar polyamide; polyimide; polypropylene, polyethylene, or a similar polyolefin; polychlorovinyl or a similar polyhalogenated vinyl; acrylic resin; a soft inorganic substance such as dry ice, sodium hydrogencarbonate, or sodium carbonate, of which the use of soft organic substances is preferable, especially dry ice, which does not remain on the surface after treatment.

The blast treatment is superior to the brush treatment from the viewpoint of uniformity of microroughness formed on the surface of the potting material, especially because blasting can produce microroughness in the vicinity of the LEDs 3 as well.

If necessary, the brush treatment and blast treatment can be combined, i.e., blasting with fine particles can be carried out simultaneously with brushing.

It is recommended to perform the aforementioned surface treatment after the potting material 4 is cured to a certain degree. In particular, it is recommended to conduct surface treatment after the JIS Type A hardness of the potting material 4 measured in JIS Type A units in accordance with JIS K6249 reached 50% of the final JIS Type A hardness required for this surface. If surface treatment is carried out when the JIS Type A hardness of the potting material is less than 50%, this will impair efficiency of surface treatment or will produce insufficient microroughness in subsequent curing.

In order to protect the LEDs 3, it is also recommended to conduct an antistatic treatment prior, during, or after surface treatment. Antistatic treatment can be carried out, e.g., by distributing a small amount of water or an aqueous solution of reduced-melting-point ethylene glycol over the surface of the display device. Furthermore, the antistatic treatment of the surface can be carried out by using surface-active agents or the aforementioned agents in combination with an ionizer or by steaming the surface with the use of a steam-generating device.

It is necessary to control the antistatic treatment with use of a special charge-measuring device. This is because the use of an excessive amount of water during antistatic treatment performed simultaneously with the surface treatment or the use of grounding wires of extreme density may significantly reduce surface treatment efficiency.

Since the display device of the type shown in FIGS. 1 and 2 and produced by the above-described method has spaces between the LEDs 3 on the substrate 2 filled with the potting material 4, atmospheric moisture and dust cannot penetrate to the substrate 2, irrespective of the fact that the display device is used outdoors. The aforementioned display device provides high visibility of the displayed information since reflection of light from the potting material and glossiness of the potting material are restricted even when the device is exposed to the external incident light. Therefore, the display device of the invention is suitable for displaying outdoor signals, traffic control signs, or for advertisement display panels.

The aforementioned surface-treatment processes (1) to (3) can be used for improving the visibility of images reproduced on the existing display devices having surfaces defined by light-emitting and non-light-emitting regions. In such a manner, it becomes possible to physically reduce glossiness on the surface of non-light-emitting regions, increase display contrast, and improve the visibility of images displayed by display devices that have been used outdoors for several years. Such a method will significantly reduce cost as compared to the manufacture of new display devices.

EXAMPLES

The invention will now be described in more detail by way of application examples, which, however, should not be construed as limiting the scope of application of the invention.

Reference Example 1

A liquid silicone-type potting material (EE-1840; a product of Dow Corning Toray Co., Ltd.) was injection-molded into a flat 4 mm-thick plate which was cured for 2 hours at 70° C. The cured plate was used for cutting out square pieces having a side of 10 cm. The surfaces of the square pieces were treated by means of abrasive paper to different levels of roughness, and, as a result, several comparative specimens having a 60°-mirror-surface glossiness according to JIS Z 8741 in the range of 0% to 60% were obtained.

Reference Example 2

Bullet-shaped light-emitting diodes (LEDs; diameter: 5 mm; epoxy-mold length: 9 mm) molded from an epoxy resin were arranged in a net-like pattern on a common 70 mm×45 mm electronic circuit board. With the LEDs facing up, the circuit board was placed onto the bottom of a black ABS case having a length of 70 cm and a width of 45 cm, and then the circuit board was coated with a liquid silicone-type potting material (EE-1840; the product of Dow Corning Toray Co., Ltd.) so that tips of the epoxy molds of the LED projected for about 7 mm above the surface. The coating was heated for 1 hour at 70° C., whereby the silicone-type potting material was cured and turned into a silicone elastomer. Final JIS A hardness of the silicone elastomer was equal to 20, but after 1 hour heating at 70° C. it became equal to 17. The light emitting regions made from the aforementioned epoxy-molded LEDs were arranged on the non-light-emitting regions made from the silicone elastomer in a net-like pattern with a 23 mm pitch. As a result, a display device consisting of light-emitting regions projecting from non-light-emitting regions was produced. The surface of the silicone elastomer had a 60°-mirror-surface glossiness according to JIS Z 8741 equal to 60%.

Application Example 1

A Nylon wheel brush (diameter: 100 mm; thickness: 12 mm; Nylon fiber diameter: 0.5 mm; fiber length: 30 mm) was attached to an electric motor and brought into contact with the display device obtained in Reference Example 2 for treating the display surface at 2400 rpm at a rate of 120 $cm^2$/min in order to diminish glossiness only on non-light-emitting regions made from the silicone elastomer. As compared to glossiness of the comparative material of Reference Example 1, a 60°-mirror-surface glossiness according to JIS Z 8741 obtained on non-light-emitting regions of this example was in the range of 0 to 1%. The surface of the silicone elastomer had microroughness. Results of detailed visual inspection of bond surfaces with the silicone elastomer, epoxy mold, and the ABS case did not reveal any damages, such as separations, etc.

Application Example 2

Charge conditions on the ABS case used in Application Example 1 were measured with the use of a KSD-0103 charge monitor (the product of Kasuga Co., Ltd.) and revealed a maximum charge of 60 kV. After the surface of the silicone elastomer was irrigated with water, the surface was subjected to the same treatment as in Application Example 1. As a result, non-light-emitting regions made from silicone elastomer and forming non-light-emitting regions having a 60°-mirror-surface glossiness of 1 to 3% according to JIS Z 8741 were obtained. This time, the maximum charge was 1 kV.

Thus, the use of a small amount of water made it possible to significantly suppress the charge and reduce glossiness on the surface of the display device without decrease in the surface-treatment rate and glossiness on the image portions.

Application Example 3

Surface treatment was conducted under the same conditions as in Application Example 1, except that the diameter of the Nylon fibers was 0.7 mm. As compared to glossiness on the surface of the comparative material of Reference Example 1, a 60°-mirror-surface glossiness according to JIS Z 8741 obtained on the non-light-emitting regions of silicone elastomer was in the range of 0 to 1%. Results of microscopic observation of the Epoxy-molded LED did not reveal any damages. On the other hand, the surface of silicone elastomer had microroughness similar to the one obtained in Application Example 1 with the depth of valleys equal to 0.5 mm. Results of detailed visual inspection of bond surfaces with the silicone elastomer, epoxy mold, and the ABS case did not reveal any damages, such as separations, etc.

Application Example 4

A Nylon end brush (Nylon bristles having a fiber diameter of 0.5 mm and length of 30 mm attached to a 25 mm-diameter cylindrical body in parallel to the axis of rotation) thickness: 12 mm; Nylon fiber diameter: 0.5 mm; fiber length: 30 mm) was attached to an electric motor and brought into contact with the display device obtained in Reference Example 2 for treating the display surface at 2400 rpm at a rate of 100 $cm^2$/min in order to diminish glossiness only on non-light-emitting regions made from the silicone elastomer. As compared to glossiness on the surface of the comparative material of Reference Example 1, a 60°-mirror-surface glossiness according to JIS Z 8741 obtained on the non-light-emitting regions of this example was in the range of 1 to 5%. The Epoxy-molded LED was observed under a microscope, but not damages could be revealed. On the other hand, the surface of the silicone elastomer had microroughness. Results of detailed visual inspection of bond surfaces with the silicone elastomer, epoxy mold, and the ABS case did not reveal any damages, such as separations, etc.

Application Example 5

Surface treatment was conducted under the same conditions as in Application Example 1, except that the brush was made from polypropylene. As compared to glossiness on the surface of the comparative material of Reference Example 1, glossiness according to JIS Z 8741 obtained on the non-light-emitting regions of silicone elastomer was in the range of 0 to 1%. Results of microscopic observation of the Epoxy-molded LED did not reveal any damages. On the other hand, the surface of silicone elastomer had microroughness. Results of detailed visual inspection of bond surfaces with the silicone elastomer, epoxy mold, and the ABS case did not reveal any damages, such as separations, etc.

Comparative Example 1

Surface treatment was conducted under the same conditions as in Application Example 5, except that the wheel brush was made from Nylon containing alumina (thickness 0.7 mm). The surface of the Epoxy-molded LED was damaged prior to decrease of glossiness on the surface of the non-light-emitting regions.

Surface treatment was conducted under the same conditions as in Application Example 5, except that the wheel brush was made from steel wires (thickness 0.5 mm). The surface of the Epoxy-molded LED was damaged prior to decrease of glossiness on the surface of the non-light-emitting regions.

Surface treatment was conducted under the same conditions as in Application Example 5, except that the wheel brush was made from brass (thickness 0.3 mm). The surface of the Epoxy-molded LED was damaged prior to decrease of glossiness on the surface of the non-light-emitting regions.

Application Example 6

The surface of the display device produced in Reference Example 2 was treated with dry-ice blasting. More specifically, the aforementioned surface was blasted with dry-ice particles having diameter of 3 mm and length of 5 mm impinged onto the surface by compressed air under pressure of 0.5 MPa through a 20 mm nozzle of the NSB-30 type blasting machine of Taiyo Nippon Sanso Corporation that was moved across the surface with the blasting rate of 100 $cm^2$/min. As a result of this treatment, glossiness was reduced only on non-light-emitting regions made from a silicone elastomer. As compared to glossiness on the surface of the comparative material of Reference Example 1, 60°-mirror-surface glossiness according to JIS Z 8741 obtained on the non-light-emitting regions of silicone elastomer was in the range of 0 to 1%. Results of microscopic observation of the epoxy-molded LED did not reveal any damages. On the other hand, the surface of silicone elastomer had microroughness. Results of detailed visual inspection of bond surfaces with the silicone elastomer, epoxy mold, and the ABS case did not reveal any damages, such as separations, etc.

Application Example 7

Surface treatment was conducted under the same conditions as in Application Example 6, except that dry-ice blasting was carried out with a compressed-air pressure of 0.7 MPa and a rate of blasting equal to 50 $cm^2$/min. As compared to glossiness on the surface of the comparative material of Reference Example 1, a 60°-mirror-surface glossiness according to JIS Z 8741 obtained on the non-light-emitting regions of silicone elastomer was in the range of 0 to 1%. Results of microscopic observation of the epoxy-molded LED did not reveal any damages. On the other hand, the surface of silicone elastomer had microroughness. Results of detailed visual inspection of bond surfaces with the silicone elastomer, epoxy mold, and the ABS case did not reveal any damages, such as separations, etc.

Application Example 8

A display device was produced by the same method as in Reference Example 2, except that the liquid silicone-type potting material (EE-1840, the product of Dow Corning Toray Co., Ltd.) obtained in Reference Example 2 was replaced by a polyether-type elastomer composition obtained by uniformly mixing the following components at 5° C.: 100 g of a polypropylene oxide having both molecular terminals capped with allyl groups (viscosity: 390 mPa·s; mass-average molecular weight=3,000); 18 g of an organopolysiloxane (viscosity: 20 mPa·s) having in one molecule at least three silicon-bonded hydrogen atoms and represented by the following formula:

$$(CH_3SiO_{3/2})_{0.1}[(CH_3)HSiO_{2/2}]_{1.5}[(CH_3)_2SiO_{2/2}]_{1.5}[(CH_3)_3SiO_{1/2}]_{0.5}$$

and an isopropyl-alcohol solution of a chloroplatinic acid (with the content of metallic platinum in weight units equal to 50 ppm per weight of the composition).

In this example, the surface of each display device was surface treated by the same method as described in Application Example 1 and was produced with glossiness reduced only on the non-light-emitting regions made from the aforementioned elastomer. Treatment was carried out by the same method as in Reference Example 1, except that the liquid silicone-type potting material (EE-1840; the product of Dow Corning Toray Co., Ltd.) was replaced by the aforementioned composition. A 60°-mirror-surface glossiness according to JIS Z8741 obtained on the non-light-emitting regions made from polyether elastomer was 7%.

Application Example 9

A display device was produced by the same method as in Reference Example 2, except that the liquid silicone-type potting material (EE-1840, the product of Dow Corning Toray Co., Ltd.) obtained in Reference Example 2 was replaced by a polyisobutylene-type elastomer composition obtained by uniformly mixing the following components: 70 g of a polyisobutylene having both molecular terminals capped with allyl groups (mass-average molecular weight=20,000; glass transition point below −50° C.); 30 g of a plasticizer in the form of liquid paraffin having a viscosity of 50 mPa·s; 50 g of hydrophobic silica obtained by surface treating fumed silica having BET specific area of 200 $m^2$/g with hexamethyldisilazane; 9.1 g of a cross-linking agent in the form of an organopolysiloxane represented by the following average molecular formula:

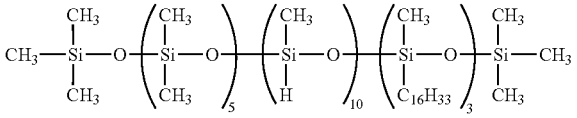

0.48 g of 1,3-divinyltetramethyldisiloxane complex of platinum, and 0.06 g of a curing inhibitor in the form of a phenylbutynol.

In this example, the surface of each display device was surface treated by the same method as described in Application Example 1 and was produced with glossiness reduced only on the non-light-emitting regions made from the aforementioned elastomer. Treatment was carried out by the same method as in Reference Example 1, except that the liquid silicone-type potting material (EE-1840; the product of Dow Corning Toray Co., Ltd.) was replaced by the aforementioned composition. A 60°-mirror-surface glossiness according to JIS Z8741 obtained on the non-light-emitting regions made from the polyisopropylene-type elastomer was 10%.

The invention claimed is:

1. A display device having a surface with light-emitting regions and non-light-emitting regions, wherein the light-emitting regions and non-light-emitting regions are subjected to simultaneous surface treatment selected from:

(1) brush treatment;

(2) blast treatment; or (3) combined brush and blast treatment, whereby after the treatment the surfaces of the light-emitting regions have a 60°-mirror-surface glossiness according to JIS Z 8741 exceeding 20%, while the surfaces of the non-light-emitting regions have a 60°-mirror-surface glossiness according to JIS Z 8741 not exceeding 20%.

2. The display device of claim 1, wherein at least a part of the light-emitting regions projects from the surfaces of the non-light-emitting regions.

3. The display device according to claim 1, wherein the Young's modulus of the light-emitting regions at 25° C. is equal to or greater than 100 MPa, and wherein the Young's modulus of the non-light-emitting regions at 25° C. is equal to or lower than 10 MPa.

4. The display device of claim 1, wherein a brush used for the brush treatment is made from plastic.

5. The display device of claim 1, wherein a material used for the blast treatment is a dry ice powder, sodium carbonate powder, sodium hydrogencarbonate powder, plastic powder, or a vegetation powder.

6. The display device according to claim 1, wherein the light-emitting regions are composed of light-emitting semiconductor elements.

7. The display device according to claim 1, wherein the non-light-emitting regions are made from an elasticity organic material.

8. The display device of claim 7, wherein the elasticity organic material is a silicone elastomer.

9. A method of manufacturing a display device having a surface with light-emitting regions and non-light-emitting regions, comprising a step of subjecting the light-emitting regions and non-light-emitting regions to simultaneous surface treatment selected from:

(1) brush treatment;

(2) blast treatment; or (3) combined brush and blast treatment, whereby after the treatment the surfaces of the light-emitting regions have a 60°-mirror-surface glossiness according to JIS Z 8741 exceeding 20%, while the surfaces of the non-light-emitting regions have a 60°-mirror-surface glossiness according to JIS Z 8741 not exceeding 20%.

10. The method of claim 9, wherein at least a part of the light-emitting regions projects from the surfaces of the non-light-emitting regions.

11. The method according to claim 9, wherein the Young's modulus of the light-emitting regions at 25° C. is equal to or greater than 100 MPa, and wherein the Young's modulus of the non-light-emitting regions at 25° C. is equal to or lower than 10 MPa.

12. The method of claim 9, wherein a brush used for the brush treatment is made from plastic.

13. The method of claim 9, wherein a material used for the blast treatment is a dry ice powder, sodium carbonate powder, sodium hydrogencarbonate powder, plastic powder, or a vegetation powder.

14. The method according to claim 9, wherein the light-emitting regions are composed of light-emitting semiconductor elements.

15. The method according to claim 9, wherein the non-light-emitting regions are made from an elasticity organic material.

16. The method of claim 15, wherein the elasticity organic material is a silicone elastomer.

17. The method according to claim 15, further comprising the step of curing the elasticity organic material and performing the surface treatment after the hardness of the elasticity organic material exceeds 50% of the value of the final hardness.

18. The method according to claim 9, further comprising the step of antistatic treatment.

19. A method of improving the visibility of a display device having a surface with light-emitting regions and non-light-emitting regions, wherein the light-emitting regions and non-light-emitting regions are subjected to simultaneous surface treatment selected from:

(1) brush treatment;

(2) blast treatment; or (3) combined brush and blast treatment, whereby after the treatment the surfaces of the light-emitting regions have a 60°-mirror-surface glossiness according to JIS Z 8741 exceeding 20%, while the surfaces of the non-light-emitting regions have a 60°-mirror-surface glossiness according to JIS Z 8741 not exceeding 20%.

20. The display device according to claim 2, wherein the Young's modulus of the light-emitting regions at 25° C. is equal to or greater than 100 MPa, and wherein the Young's modulus of the non-light-emitting regions at 25° C. is equal to or lower than 10 MPa.

* * * * *